US011098619B2

(12) United States Patent
Grueneberg et al.

(10) Patent No.: US 11,098,619 B2
(45) Date of Patent: Aug. 24, 2021

(54) METHOD FOR PRODUCING A COPPER-INFILTRATED VALVE SEAT RING

(71) Applicant: Mahle International GmbH, Stuttgart (DE)

(72) Inventors: Heiko Grueneberg, Zell im Wiesental (DE); Heiko Heckendorn, Schopfheim (DE); Patrick Sutter, Schopfheim (DE); Klaus Wintrich, Schopfheim (DE)

(73) Assignee: Mhale International GmbH

( * ) Notice: Subject to any disclaimer, the term of this patent is extended or adjusted under 35 U.S.C. 154(b) by 0 days.

(21) Appl. No.: 16/686,096

(22) Filed: Nov. 15, 2019

(65) Prior Publication Data

US 2020/0157978 A1 May 21, 2020

(30) Foreign Application Priority Data

Nov. 16, 2018 (DE) ..... 102018219686.9

(51) Int. Cl.
*F01L 3/02* (2006.01)
*B22F 3/10* (2006.01)
*B22F 3/00* (2021.01)

(52) U.S. Cl.
CPC ..... *F01L 3/02* (2013.01); *B22F 3/001* (2013.01); *B22F 3/1035* (2013.01)

(58) Field of Classification Search
CPC ..... F01L 3/02; F01L 2303/01; F01L 2820/01; B22F 3/1035; B22F 3/001; B22F 5/10; B22F 3/20; B22F 3/03
See application file for complete search history.

(56) References Cited

U.S. PATENT DOCUMENTS 4,168,162 A 9/1979 Shafer
4,485,147 A * 11/1984 Nishino ..... C22C 33/0207 419/2
6,551,373 B2 4/2003 Alcini et al.
7,757,396 B2 * 7/2010 Sawada ..... B22F 1/0003 29/888.44
2008/0019858 A1 * 1/2008 Mars ..... C22C 38/42 419/36
2013/0315772 A1 * 11/2013 Christopherson, Jr. ..... C22C 33/0285 419/14
2018/0209311 A1 7/2018 Heckendorn et al.
2019/0143415 A1 5/2019 Kohler et al.

FOREIGN PATENT DOCUMENTS

CN 101518819 B * 11/2011
DE 102015213706 A1 1/2017
DE 102016109539 A1 12/2017
JP 2006002578 A * 1/2006

* cited by examiner

*Primary Examiner* — Jacob M Amick
*Assistant Examiner* — Charles J Brauch
(74) *Attorney, Agent, or Firm* — Fishman Stewart PLLC

(57) ABSTRACT

A method for producing a copper-infiltrated valve seat ring and a valve seat ring are disclosed. The method includes introducing a copper powder and a functional material powder mixture into a joint cavity, simultaneously forming the copper powder and the functional material powder mixture into a green body comprising a functional section and a copper section in the joint cavity by the mold element, and sintering the green body formed in step b) to produce the valve seat ring where the copper section liquefies during the sintering and infiltrates pores present in the functional section.

16 Claims, 2 Drawing Sheets

METHOD FOR PRODUCING A COPPER-INFILTRATED VALVE SEAT RING

CROSS-REFERENCE TO RELATED APPLICATION

This application claims priority to German Application No. DE 10 2018 219 686.9, filed on Nov. 16, 2018, the contents of which are hereby incorporated by reference in its entirety.

TECHNICAL FIELD

The invention relates to a method for producing a copper-infiltrated valve seat ring and a valve seat ring, which is produced by carrying out this method. The invention further relates to a tribological system comprising such a valve seat ring and an internal combustion engine comprising such a valve seat ring and, alternatively or additionally, such a tribological system.

BACKGROUND

It is known to powder metallurgically produce valve seat rings for inlet and outlet valves in such a way that a functional section of a functional material is copper-infiltrated during a sintering process. While the functional section is wear-resistance, the copper primarily contributes to the heat conductivity of the valve seat ring.

Such valve seat rings are usually produced in that a ring-shaped functional green body and a ring-shaped copper green body are each pressed in a press. The two green bodies are subsequently arranged relative to one another in such a way that the copper green body liquefies in response to the following sintering process and infiltrates pores, which are present in the functional section. Alternatively, copper rings are also wound of copper wires Instead of pressing copper green bodies.

Valve seat rings comprising a low ring height, in particular comprising a ring height of less than 4 mm, turn out to be advantageous for load change ratios of an internal combustion engine, but also to be advantageous for a cooling of the cylinders by an enabled smaller distance to a water jacket of the internal combustion engine.

In terms of production, however, it turns out to be difficult to press copper green bodies, which are suitable for such valve seat rings, due to the small ring height, in particular in the case of ring heights of less than 1 mm.

Wound copper rings, in contrast, can be produced more easily, but often have a gap and an entanglement in the ring. This has the result that the arrangement of the copper ring and of the functional green body, which is essential for an optimal geometry of the valve seat ring, can shift relative to one another, in particular in response to vibrations and shocks during the production. In addition, a determination of the required copper amount in the case of wound copper rings is often imprecise and wire winding machines have to be provided.

SUMMARY

It is an object of the present invention to create a more precise, more reliable and more cost-efficient method for producing a copper-infiltrated valve seat ring. In particular more cost-efficient valve seat rings and those, which have a lower ring height, are to be produced by such a method, so that the above-mentioned disadvantages are eliminated or at least reduced.

According to the invention, this object is solved by the subject matter of the independent patent claim(s). Advantageous embodiments are the subject matter of the dependent patent claims.

It is thus the basic idea of the invention to press a copper powder and a functional material powder mixture in a joint press and in a single pressing process. A copper-infiltrated valve seat ring of a small height can be produced in a particularly precise, reliable and also cost-efficient manner in this way, without requiring further presses or wire winding machines.

A method according to the invention serves to produce a copper-infiltrated valve seat ring. According to the method, a copper powder and a functional material powder mixture are introduced into a joint cavity, which is present in a mold element of a molding device. The introduced copper powder and the introduced functional material powder mixture are then simultaneously formed in the joint cavity by the mold element, in particular by pressing, to form a joint green body comprising a functional section and a copper section. The formed green body is subsequently sintered in such a way to produce the valve seat ring that the copper section liquefies during the sintering and infiltrates pores, which are present in the functional section.

Advantageously, the copper powder and the functional material powder mixture are essentially not mixed with one another during the introduction of the copper powder and of the functional material powder mixture. A particularly advantageous setup relating to the infiltration of the functional section with liquefied copper section and relating to a subsequent use of the valve seat ring to be produced is attained in this way.

According to an advantageous embodiment, the copper powder is introduced prior to the functional material powder mixture or vice versa. This embodiment provides for a particularly cost-efficient and simple influencing of the setup of the green body to be formed and of the valve seat ring to be produced, and ensures that the copper powder and the functional material powder mixture are present in the cavity so as to be separated particularly well.

According to another advantageous embodiment, the copper powder and the functional material powder mixture are introduced simultaneously. This embodiment provides for a particularly time-saving performance of the method to be produced.

The introduced copper powder is preferably pre-formed by a pre-forming device, in particular by pressing. This embodiment also provides for a particularly cost-efficient and simple influencing of the setup of the green body to be formed and of the valve seat ring to be produced, and ensures that the copper powder and the functional material powder mixture are present in the cavity so as to be separated particularly well.

According to a preferred embodiment, the introduced functional material powder mixture includes iron and between 0 and 15% by weight of Mo, Si, W, V, C, P, Ni, Cr, Cu, Co, N, and Mn each, as well as production-related impurities. Alternatively or additionally, 90% of the particles of the functional material powder mixture have a maximum diameter of between 25 μm and 344 μm. Alternatively or additionally, maximally 20% of the particles of the functional material powder mixture have a maximum diameter of less than 40 μm. Alternatively or additionally, maximally 10% of the particles of the functional material powder mixture have a maximum diameter of larger than 300 μm. A functional section of the green body, which is particularly wear-resistant and which can be infiltrated particularly effectively, is created in this way.

According to a further preferred embodiment, the introduced copper powder includes production-related impurities as well as maximally 10% of alloying elements, in particular between 0 and 5% by weight of Fe, Mn, Sn, Zn, Al and Ni each. Alternatively or additionally, maximally 5% of the particles of the copper powder have a maximum diameter of larger than 177 μm. A copper section of the green body is created in this way, which infiltrates the functional section particularly well and which additionally attains optimal heat conducting properties of the valve seat ring to be produced, so that heat can be discharged particularly effectively to said water jacket via the valve seat ring.

Particularly preferably, the copper section has a height of less than 1 mm, preferably of less than 0.7 mm, measured along the axial direction, after the molding. A particularly effective infiltration of the functional section with the liquefied copper section is made possible in this way. In addition, optimal heat conducting properties of the valve seat ring to be produced are thus also attained, so that heat can be discharged particularly effectively to said water jacket via the valve seat ring.

According to an advantageous embodiment, the copper section and the functional section are arranged next to one another along an axial direction after the molding. This turns out to be particularly advantageous for the molding of the functional section and of the copper section of the green body along the direction of the force of gravity, and additionally optimizes the infiltration of the functional section during the sintering.

According to a particularly advantageous embodiment, a surface, which completely separates the functional section and the copper section, extends in a plane perpendicular to the axial direction of the valve seat ring after the molding. This also turns out to be particularly advantageous for the molding of the functional section and copper section of the green body along the direction of the force of gravity, and additionally optimizes the infiltration of the functional section during the sintering.

The invention further relates to a valve seat ring, which is produced according to the above-introduced method. The above-described advantages of the above-introduced method thus also transfers to the valve seat ring according to the invention.

According to a preferred embodiment of the valve seat ring, the valve seat ring has a height of less than 4 mm, measured along an axial direction. When using the valve seat ring produced according to the method according to the invention on a cylinder head of an internal combustion engine, this turns out to be advantageous for load change ratios in the internal combustion engine, but also for a cooling of the cylinders thereof based on the distance, which is associated with a low ring height, to a water jacket provided in the internal combustion engine.

The invention also relates to a tribological system, which comprises a valve seat ring produced according to the above-introduced method. The above-described advantages of the above-introduced method and of the valve seat ring produced according to the above-introduced method thus also transfer to the tribological system according to the invention.

The invention further relates to an internal combustion engine for a motor vehicle. The internal combustion engine comprises a valve seat ring produced according to the above-introduced method, and, alternatively or additionally, to an above-introduced tribological system. The above-described advantages of the above-introduced method of the valve seat ring produced according to the above-introduced method and of the above-introduced tribological system thus also transfer to the internal combustion engine according to the invention.

Further important features and advantages of the invention follow from the subclaims, from the drawings, and from the corresponding figure description on the basis of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the following description.

DETAILED DESCRIPTION

Figure 1:
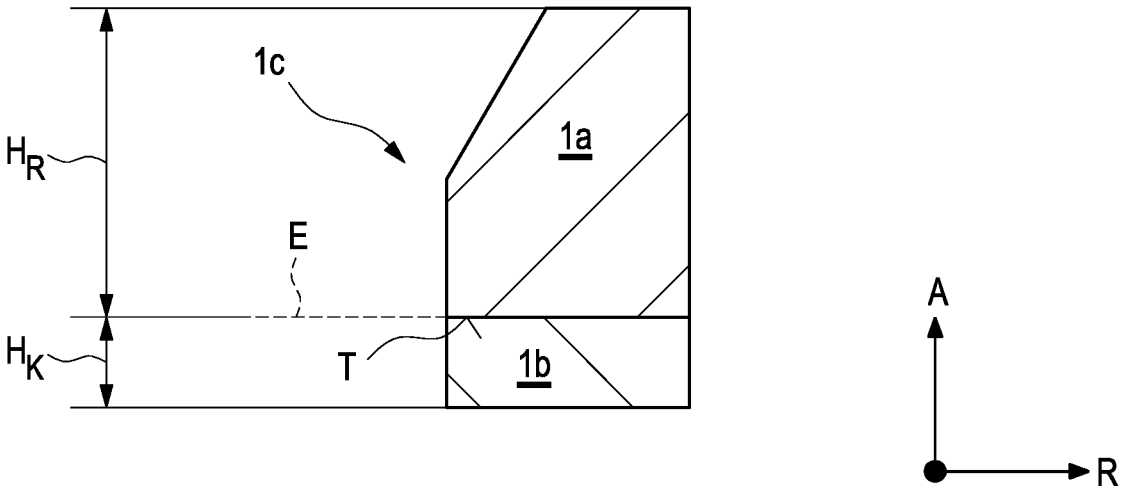
FIG. 1 illustrates a sectional view of a simplified example of a formed green body of a valve seat ring.

FIG. 1 illustrates a sectional illustration of a simplified example of a formed green body 1*c*. The green body 1*c* comprises a functional section 1*a* and a copper section 1*b*. The functional section 1*a* and the copper section 1*b* are arranged next to one another along an axial direction A, and are separated by a separation plane T, which is arranged between the functional section 1*a* and the copper section 1*b*. In the example of FIG. 1, the separation plane T runs along a radial direction R of the valve seat ring 1, extends in a plane E, which is perpendicular to the axial direction A of the valve seat ring, and completely separates the functional section 1*a* and the copper section 1*b* along a cross section of the green body 1*c*. It is also conceivable that the separation plane T runs along the axial direction A of the valve seat ring 1.

The copper section has a height $H_K$ of less than 1 mm, preferably of less than 0.7 mm, measured along the axial direction A. The copper section 1*b* can also have between 20% and 30% of the mass of the functional section 1*a*. The functional section 1 has a height $H_R$ of less than 4 mm, measured along the axial direction A.

Figure 2:
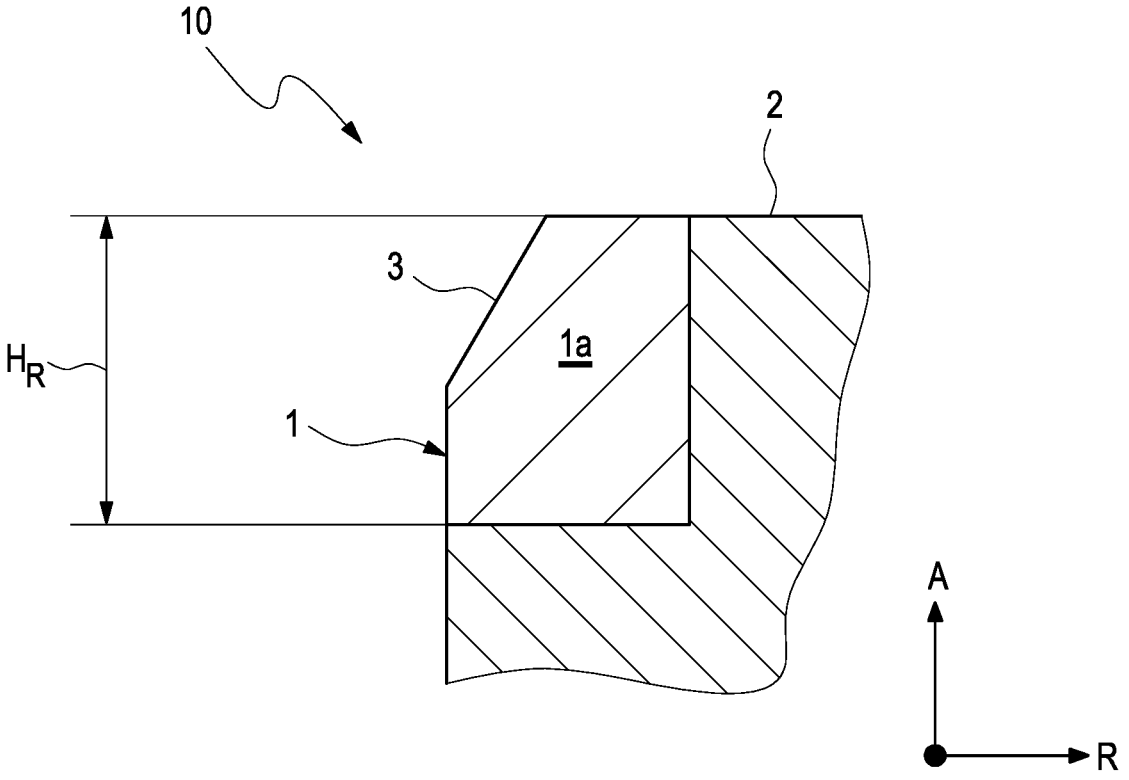
FIG. 2 illustrates a sectional view of a simplified example of a valve seat arrangement comprising a valve seat ring.

FIG. 2 illustrates a sectional illustration of a simplified example of a valve seat arrangement 10 comprising a valve seat ring 1, which is mounted to a cylinder head 2 of an internal combustion engine and which is produced according to the invention, in a cross section along an axial direction A of the valve seat ring 1.

The valve seat ring 1 encases a valve opening of the cylinder head 2, which can be closed by a valve body (not shown in FIG. 2). A section of the valve seat ring 1, which is inclined towards the axial direction A, forms the valve seat 3, on which a valve plate (not shown in FIG. 1) of the valve body abuts in a closing position.

The valve seat ring 1 essentially only still comprises the dimensions of the functional section, which was infiltrated with the liquefied copper section, and has a ring height $H_R$ of less than 4 mm, measured along the axial direction A.

Figure 3:
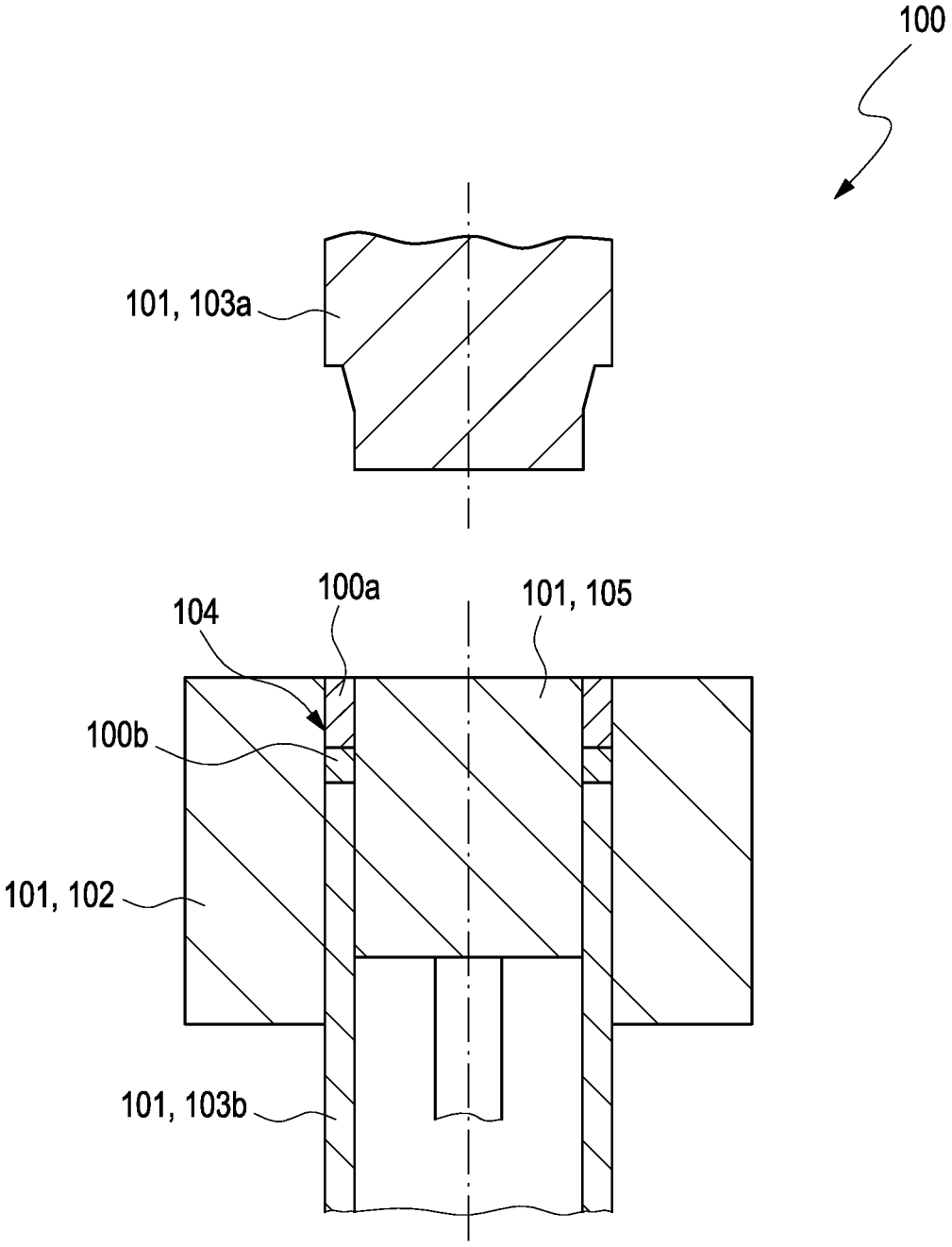
FIG. 3 illustrates an example of a molding device configured to carry out a method for producing a valve seat ring according to the disclosure.

FIG. 3 shows an example of a molding device 100, which is configured for carrying out the method according to the invention. The molding device 100 comprises a multi-part molding element 101, which comprises a molding matrix 102, an upper die 103, lower die 103*b*, and a core rod 105.

A cavity 104, which is arranged in a ring-shaped manner around an axis in the image plane in the example of FIG. 3 and which can be seen in a cross section along this axis in FIG. 3, is configured between the mold matrix 102 and the core rod 105. A copper powder 100*b* and a functional material powder mixture 100*a* are introduced into the cavity 104 in the example of FIG. 1.

The method according to the invention will be described in an exemplary manner below on the basis of FIGS. 1 to 3:

For carrying out the method, the copper powder 100*b* and the functional material powder mixture 100*a* are introduced into the same, joint cavity 104. The copper powder 100*b* can thereby be introduced prior to the functional material powder mixture 100*a*, or the functional material powder mixture 100*a* can be introduced prior to the copper powder 100*b*. The copper powder 100*b* and the functional material powder mixture 100*a* can also be introduced simultaneously. The copper powder 100*b* and the functional material powder mixture 100*a* can thereby be introduced into the cavity 104 in such a way that the copper powder 100*b* and the functional material powder mixture 100*b* are essentially not mixed with one another during the introduction.

The functional material powder mixture can thereby include metal powder on the basis of iron, copper or cobalt, hard phases, carbon, chromium, manganese, nickel, molybdenum, copper, silicon, vanadium, tungsten, cobalt, niobium, copper, sulfur, calcium, tri-iron phosphide, bronze, phosphor, pressing additives, flow improvers, graphite, sulfides, calcium difluoride, organic and inorganic binding agents, waxes, solid lubricants, production-related impurities, and further materials, which are common for the production of wear-resistant valve seat rings. In the example of FIGS. 1 to 3, the introduced functional material powder mixture includes iron and between 0 and 15% by weight of Mo, Si, W, V, C, P, Ni, Cr, Cu, Co, N, and Mn each, as well as production-related impurities. In addition, 90% of the particles of the functional material powder mixture have a maximum diameter of between 25 μm and 344 μm, maximally 20% of the particles of the functional material powder mixture have a maximum diameter of less than 40 μm, and maximally 10% of the particles of the functional material powder mixture have a maximum diameter of larger than 300 μm.

The copper powder can include Fe, Mn, Sn, Zn, Al, Ni, pressing additives, flow improvers, organic and inorganic binding agents, waxes, solid lubricants and production-related impurities. In the example of FIGS. 1 to 3, the introduced copper powder includes production-related impurities as well as maximally 10% of alloying elements, each comprising between 0 and 5% by weight of Fe, Mn, Sn, Zn, Al, and Ni. In addition, maximally 5% of the particles of the copper powder have a maximum diameter of larger than 177 μm.

In the joint cavity 104, the introduced copper powder 100*b* and the introduced functional material powder mixture 100*a* are then simultaneously formed in the joint cavity 104 to form a joint green body 1*c* comprising a functional section 1*a* and a copper section 1*b* by the mold element 101, in particular by pressing. In the example of FIG. 3, the introduced copper powder 100*b* and the introduced functional material powder mixture 100*a* are thereby formed in a joint pressing process by pressing the upper die 103*a* against the mold matrix 102 and core rod 105. The lower die 103*b* is thereby pushed against the pressed-on upper die 103*a* after the pressure contact thereof with the lower die 103*b*, in order to further compact the introduced copper powder 100*b* and the introduced functional material powder mixture 100*a*. The introduced copper powder 100*b* can also be pre-formed by means of a pre-forming device (not shown in FIG. 3), which is embodied in particular on the molding device 100, in particular by pressing. The copper green body and the functional green body are integrally formed with one another after the forming.

The formed green body is subsequently sintered to form the valve seat ring in such a way that the copper section liquefies during the sintering and infiltrates pores, which are present in the functional section. The copper section is thereby received completely by the functional section by capillary forces.

The valve seat ring 1 can be machine-finished after the production of the valve seat ring 1 and after the arrangement and the press-in of the valve seat ring 1 on the cylinder head 2.

The invention claimed is:

1. A method for producing a copper-infiltrated valve seat ring, comprising the following steps:

a) Introducing a copper-based powder and a functional material powder mixture into a joint cavity provided in a mold element of a molding device, b) Simultaneously forming the copper-based powder introduced in step a) and the functional material powder mixture introduced in step a) into a green body comprising a functional section and a copper section in the joint cavity by the mold element, and c) Sintering the green body formed in step b) to produce the valve seat ring, wherein the copper section liquefies during the sintering and infiltrates pores present in the functional section;

wherein while performing step a) the copper-based powder and the functional material powder mixture are essentially not mixed with one another, wherein the functional material powder mixture introduced in step a) includes iron, between 0 and 15% by weight of each of Mo, Si, W, V, C, P, Ni, Cr, Cu, Co, N, and Mn, and production-related impurities, and wherein 90% of the particles of the functional material powder mixture have a maximum diameter of between 25 μm and 344 μm, 20% or less of the particles of the functional material powder mixture have a maximum diameter of less than 40 μm, and 10% or less of the particles of the functional material powder mixture have a maximum diameter of larger than 300 μm.

2. The method according to claim 1, wherein step a) includes introducing the copper-based powder into the joint cavity prior to the functional material powder mixture or vice versa.

3. The method according to claim 1, wherein step a) includes introducing the copper-based powder and the functional material powder mixture simultaneously into the joint cavity.

4. The method according to claim 1, wherein the copper-based powder introduced in step a) is pre-formed by a pre-forming device.

5. The method according to claim 1, wherein at least one of:

the copper-based powder introduced in step a) includes production-related impurities and up to 10% by weight of alloying elements, and 5% or less of the particles of the copper powder have a maximum diameter of larger than 177 μm.

6. The method according to claim 1, wherein after performing step b), the copper section has a height of less than 1 mm measured along the axial direction (A).

7. The method according to claim 1, wherein after performing step b), further including arranging the copper section and the functional section next to one another along an axial direction.

8. The method according to claim 1, wherein after performing step b), a surface that completely separates the functional section and the copper section extends in a plane perpendicular to an axial direction.

9. A valve seat ring, comprising:

a sintered green body including a copper section and a functional section;

wherein the copper section is composed of copper and infiltrates pores present in the functional section;

wherein the functional section is composed of a functional material powder mixture including iron, between 0 and 15% by weight of each of Mo, Si, W, V, C, P, Ni, Cr, Cu, Co, N, and Mn, and production-related impurities; and wherein 90% of the particles of the functional material powder mixture have a maximum diameter of between 25 μm and 344 μm, 20% or less of the particles of the functional material powder mixture have a maximum diameter of less than 40 μm, and 10% or less of the particles of the functional material powder mixture have a maximum diameter of larger than 300 μm.

10. The valve seat ring according to claim 9, wherein the valve seat ring has a height of less than 4 mm, measured along an axial direction.

11. A tribological system, comprising:

a valve seat ring, the valve seat ring including:

a green body including a copper section and a functional section; and wherein the copper section is composed of copper and infiltrates pores present in the functional section;

wherein the functional section is composed of a functional material powder mixture including iron, between 0 and 15% by weight of each of Mo, Si, W, V, C, P, Ni, Cr, Cu, Co, N, and Mn, and production-related impurities, and wherein 90% of the particles of the functional material powder mixture have a maximum diameter of between 25 μm and 344 μm, 20% or less of the particles of the functional material powder mixture have a maximum diameter of less than 40 μm, and 10% or less of the particles of the functional material powder mixture have a maximum diameter of larger than 300 μm; and wherein the copper of the copper section is composed of includes production-related impurities and up to 5% by weight of each of Fe, Mn, Sn, Zn, Al and Ni, and wherein 5% or less of the particles of the copper powder have a maximum diameter of larger than 177 μm.

12. An internal combustion engine for a motor vehicle, comprising a valve seat ring as claimed in claim 9.

13. The method according to claim 1, wherein step b) of simultaneously forming the copper-based powder and the functional material powder mixture includes pressing the copper powder and the functional material powder mixture into the green body.

14. The method according to claim 1, wherein the copper-based powder introduced in step a) includes production-related impurities and between 0 and 5% by weight of each of Fe, Mn, Sn, Zn, Al and Ni.

15. The method according to claim 1, further comprising pre-forming the copper-based powder via pressing prior to introducing the copper-based powder and the functional material powder mixture into the joint cavity.

16. The method according to claim 6, wherein the height of the copper section is less than 0.7 mm after performing step b).

* * * * *